US007886920B2

(12) United States Patent
Colley et al.

(10) Patent No.: US 7,886,920 B2
(45) Date of Patent: Feb. 15, 2011

(54) APPARATUS FOR CARRYING A LOAD

(76) Inventors: Stephen Colley, 45 Hawkenbury, Harlow, Essex (GB) CM19 4HZ; Carl Jewsbury, 49 Radburn Close, Harlow, Essex (GB)

( * ) Notice: Subject to any disclaimer, the term of this patent is extended or adjusted under 35 U.S.C. 154(b) by 0 days.

(21) Appl. No.: 12/252,005

(22) Filed: Oct. 15, 2008

(65) Prior Publication Data

US 2009/0166308 A1 Jul. 2, 2009

(30) Foreign Application Priority Data

Oct. 15, 2007 (GB) ..... 0720167.6

(51) Int. Cl.
*A63J 5/12* (2006.01)

(52) U.S. Cl. ..... 212/316; 472/80

(58) Field of Classification Search ..... 212/316; 472/80

See application file for complete search history.

(56) References Cited

U.S. PATENT DOCUMENTS 2,684,767 A * 7/1954 Fox ..... 212/91
2,954,879 A * 10/1960 McLean ..... 212/84
3,476,385 A 11/1969 Foy
3,575,300 A * 4/1971 Durand ..... 212/228
3,834,552 A * 9/1974 Lofink ..... 212/95
4,363,411 A * 12/1982 Blair et al. ..... 212/308
4,392,648 A 7/1983 Foy
5,147,051 A * 9/1992 Liljedahl ..... 212/71
5,492,236 A 2/1996 Foy

FOREIGN PATENT DOCUMENTS

DE 89 00 981.9 3/1990

OTHER PUBLICATIONS

European Search Report for EP 08 01 8040 dated Jan. 5, 2009.

* cited by examiner

*Primary Examiner*—Thomas J. Brahan
(74) *Attorney, Agent, or Firm*—Cook Alex Ltd.

(57) ABSTRACT

An apparatus for use in carrying a load particularly in theatrical performances comprising a supported guide rail, with a first and second carriage movably mounted on the guide rail, the first carriage being adapted to carry a movable lift line for carrying the load, and a compensator system linking the first and second carriage and being arranged such that on movement of the first carriage or the second carriage, the other carriage moves in the same direction and the second carriage moves a shorter distance than the first carriage. Lifting and lowering of the load may be achieved independently of travel along the rail and a load may be transported at a constant height.

4 Claims, 2 Drawing Sheets

APPARATUS FOR CARRYING A LOAD

CROSS REFERENCE TO RELATED APPLICATIONS

Pursuant to 35 U.S.C. §119(a), this application claims priority from Patent Application No. GB 0720167.6, filed in the United Kingdom Intellectual Property Office on Oct. 15, 2007, the contents of which are hereby incorporated by reference herein.

This invention relates to an apparatus for carrying a load, particularly to an apparatus for use in a theatrical performance. The invention relates more particularly to personnel transportation apparatus for use in theatrical performances in which a performer is transported in the air to convey the effect of flying.

The need to transport a load through the air arises in many industries for example in the movement of goods in the haulage industry, mining applications, a dockyard, railway yard or the like, in assembly operations such as may be required in manufacturing plant and in the sphere of entertainment, for example in theatrical performances. It is important to ensure reliable, safe and controlled movement of the load and this is especially so where people are being transported for example to simulate flying or other special effects in theatrical performances. Servicing of equipment in theatrical applications is often necessary and due to health and safety considerations, the use of ladders, cheery-pickers and the like may not be appropriate and the use of scaffolding is inconvenient and cumbersome.

In the transportation of a performer, safety is a prime consideration but having fine control over the movement of the performer is also important, particularly maintaining the performer at a constant height over the stage and in having universal flexibility and control over the movement of the performer. The space for production equipment in many theatrical environments may be relatively confined and the particular environment will differ from location to location. Apparatus for transporting a performer must be able to operate in a such an environment where space may be at a premium. In addition, controlling costs of equipment for use in theatrical productions is important.

Personnel transportation apparatus are known for suspending and transporting performers and typically comprise two or more tracks or fly bars. In a known system widely used in the theatrical industry a track is mounted on one of the bars along which a carriage may travel and from which a performer or scenery may be suspended and a second carriage commonly known as a compensator is mounted on the other track which has the function of maintaining the load at a constant height above the performance area. This system typically requires the two tracks to be mounted one above the other as in known systems, the suspension carriage and the compensator by necessity move in opposite directions in order to provide the desired transport effect.

U.S. Pat. No. 4,392,648 describes a personnel transportation system having two sets of rails for carrying two rollably mounted carriages. The carriages are moved by two sets of pulleys and move in opposite directions simultaneously. These sets of pulleys are interconnected by a third pulley system for controlling the height of the performer across the stage.

The present invention aims to provide an apparatus for carrying a load which provides for fine control over the movement of the load and allows the load to be carried at a constant height. The present invention also aims to provide a theatrical transportation apparatus which is usable in a confined space with reduced amounts of equipment as compared to known apparatus and which provides for quiet operation.

We have now devised an apparatus which provides excellent transportation characteristics and allows a load to be carried at a constant height along the length of the track and to be maneuvered independently in three dimensions and which requires only one track for transportation of the carrier for suspending the load and other equipment. The apparatus comprises two travelling carriages on a single rail guide.

According to a first aspect, the invention provides an apparatus for use in carrying a load comprising a supported guide rail, a head block located at or towards one end of the guide rail and a tail block located at or towards the other end of the rail, a first carriage movably mounted on the guide rail and a second carriage movably mounted on the guide rail, the first carriage being adapted to carry a movable lift line for carrying the load, and a compensator system linking the first and second carriage and being arranged such that on movement of the first carriage or the second carriage, the other carriage moves in the same direction and the second carriage moves a shorter distance than the first carriage.

According to a second aspect, the invention provides an apparatus for use in carrying a load comprising a supported guide rail, a head block located at or towards one end of the guide rail and a tail block located at or towards the other end of the rail, a first carriage movably mounted on the guide rail and carrying a movable lift line for carrying the load and a second carriage movably mounted on the guide rail, guide means for guiding the lift line on at least the first carriage, the second carriage and at least one of the head block and the tail block and a compensator system comprising a first line guided in a pathway around the head block and the tail block to link the first and second carriage and being anchored at both ends and a second line guided in a pathway to link the first and second carriage, the arrangement being such that the first and second carriage are simultaneously movable in the same direction and the second carriage travels a fraction of the distance of the first carriage upon effecting movement of the carriages.

The guide means suitably comprises a series of pulleys. The head block and tail block are suitably at or near opposite ends of the guide rail with the second carriage being nearer to the head block and the first carriage nearer to the tail block.

Suitably the first line of the compensator system is arranged such that it passes from the second carriage to the first carriage via the head block and the tail block which preferably both comprise guide means for the first line and the first line makes a greater number of passes from the second carriage to the head block than it makes from the tail block to the first carriage.

The first line is anchored at both ends and provides a fixed length whereby movement of the first carriage in the direction towards the second carriage to lengthen the line between the first carriage and the tail block necessarily requires the second carriage to move in the same direction as the first carriage thereby shortening the line between the second carriage and the head block to take up the additional line made available by the movement of the first carriage. By this arrangement, the movement of one of the first or second carriages effects movement of the other carriage in the same direction.

The second line suitably passes through guide means on either first or second carriage and links the first and second carriage together. The second line is suitably arranged such that as the first carriage is moved away from the second carriage, force is transmitted to the second carriage to pull it in a direction towards the first carriage.

According to a third aspect, the invention provides an apparatus for use in carrying a load comprising a supported guide rail, a head block comprising a pulley located at or towards one end of the guide rail and a tail block comprising a pulley located at or towards the other end of the rail, a first carriage movably mounted on the guide rail adapted to carry a suspension line for carrying a load, and a second carriage movably mounted on the guide rail located between the head block and the first carriage and being movable in the same direction as the first carriage, the second carriage comprising a pulley wherein the first carriage and second carriage are linked by a line which has at least a single pass from the first carriage to the tail block, a single pass from the tail block to the head block and a pass from the tail block to the second carriage and returning to the tail block whereby the number of passes between the head block and the second carriage is greater than the number of passes between the first carriage and the tail block, the arrangement being such that when the first carriage moves a distance "x", the second carriage moves a distance "x/n" in the same direction wherein n is the ratio of the number of passes between the head block and the second carriage to the number of passes from the tail block to the second carriage.

In a further aspect, the invention provides a method of transporting a load from a first position to a second position in the air, the load being attached to a lift line, comprising mounting a first carriage and a second carriage on a guide rail, connecting the first and second carriage together by a line passing between the first carriage and the second carriage via guide means located at or near both ends of the guide rail and making a second pass of line from the second carriage and in a direction away from the first carriage, connecting the first and second carriage by a second line linking the carriages directly, securing both ends of the first and second line to the arrangement being such that movement of the first carriage causes the second carriage to move in the same direction as the first carriage and to move a fraction of the distance moved by the first carriage, mounting a lift line in guide means on the first carriage and the second carriage whereby a first end is adapted to receive a load to be carried below the first carriage and the other end is linked to drive means whereby the load is liftable independently of movement of the first carriage along the guide rail and effecting movement of the load horizontally by moving the first carriage and/or vertically by moving the lift line.

The first carriage and/or second carriage may be moved to effect movement of the other carriage. Preferably a motive force is applied to the first carriage. On applying a load to the lift line, the horizontal forces on the first carriage in the line of the guide rail remain in balance as the lift line is independent of the compensation system. This provides the advantage that the force required to move the carriages need only be sufficient to overcome frictional losses rather than being influenced by the load.

The lift line and for traverse line may be moved manually or automatically and provide movement of the first and second carriage along the guide rail. Motive force may be applied by a motor or engine or by manual means. Movement may suitably provided by means of a rope, cable a tensioned drive belt, compound drum, captive enclosed belt or drive or by the use of known track systems that allow for horizontal movement of the carriages along the guide rail. The lift line and/or traverse line where present may be operated independently by suitable electrical, hydraulic or motorised means, for example a compound drum and electrical winch.

Suitably, the lift line and/or traverse line are may be operated both manually and automatically and the apparatus comprises means by which any automatic motive system may be disengaged to allow manual operation.

In one embodiment, a winding apparatus, for example located at one or other end of the guide rail, may be employed as part of the apparatus in order to move the carriages along the guide rail. In a preferred embodiment, the first carriage is moved by a traverse line which is operable remotely either manually or in an automated manner for example using an electrical winch.

In an especially preferred embodiment, the apparatus is controlled automatically using software to control one or more of the lift line and traverse line. The apparatus may comprise a control system to allow automated operation of the apparatus according to stored information relating to a desired direction of movement or timing of movement of the load using the lift line and/or traverse line.

In a preferred method of operation, the lift line and/or traverse line is operated manually and the control system stores information relating to the sequence of movements of the lift line and/or traverse line operations which may then be retrieved and used automatically to operate the apparatus in such a manner to replicate the manual operations. In this way, technicians may provide fine artistic control of the load being transported and this may then be replicated automatically using the control system.

Preferably the lift line and/or traverse line are linked to one or more electromechanical counting devices or encoders which provide a precise measurement of the distance and time over which the line is moved and/or the number of revolutions of the guide means, for example a pulley. Suitably the counting device is able to translate the distance and/or time into digital information which may be stored and subsequently retrieved to replicate the movement of the lines and/or pulleys and thereby allow automatic replication of the movement of the load. The retrieved information may be employed to drive the same apparatus or more than one apparatus, for example simultaneously.

In a further aspect, the invention provides a theatrical flying system comprising a first apparatus according to the invention which is manually operable and which comprises a recordal system to record information relating to the movement of the lift line and/or traverse line, a second apparatus according to the invention which is automatically operable and operably linked to the first system and movable according to the recorded information so as to replicate the movement of the load of the first system simultaneously or sequentially.

This system is especially useful in the recorded visual media industry for example in film-making as it may allow a reduction in the amount of time required for rehearsals in filming.

The invention further provides a method of transporting a load in a pre-determined direction comprising providing apparatus according to the invention equipped with a lift line and wherein the first and/or second carriage is automatically controllable and movable according to a pre-determined control sequence, attaching a load to the lift line and activating the automatic control sequence whereby the load is transported in a pre-determined direction.

Automatic operation of the system is particularly desirable as this may allow significant savings in time and cost in producing recorded visual media by reducing the amount of rehearsal and training time required.

In a preferred method of producing a recorded visual medium, a load is suitably transported using the apparatus of the invention by manual operation and the movement of the apparatus is suitably recorded to provide information relating to the pre-determined direction of movement of the load in a retrievable form encoding the movement of the lift line, optionally the traverse line. The retrievable information may then be employed subsequently to control automatic movement of the apparatus to move the load in the pre-determined direction without manual intervention. This system of operation also may be employed in combination with other film-making techniques, for example in producing computer generated images with movement of a load superimposed on the computer generated images.

Independently of the movement of the carriages along the track, the lift fine is operable to raise or lower the load. This may be powered as desired. This may be carried out automatically or manually but preferably is operated using known machinery, for example a winch, block and fall, compound drum, weights and the like. Where electrical equipment is employed to provide powered lifting and lowering, this may be located remotely or at one end of the bar to provide a safe environment and protect from exposure to adverse or wet conditions that may be encountered by the moving suspended load.

Advantageously, the apparatus of the invention is provided on a single bar. Furthermore, providing two carriages on a single guide rail significantly simplifies the apparatus as compared to known systems and provides safe and efficient operation. The amount of equipment required is significantly less than that associated with known systems and so simplifies construction and transport and allows the apparatus to be mounted in less space than typically required for conventional systems.

The first and second carriages travel along the guide rail in the same direction which further enhances the safety of the operation by the need for fewer moving parts as compared to known apparatus. The second carriage travels a fraction, for example half the distance of the first carriage but the reeving of the line around the head block, the first carriage and second carriage pulley adjusts the length of the line so a constant height above the ground of the load being transported is maintained.

Preferably, the apparatus of the invention has two passes of line between the head block and the second carriage and one pass of line between the first carriage and the tail block.

The apparatus is especially useful in applications for transporting a load in adverse conditions where water or rain may be present for example in the external environment or in a theatrical performance involving water. Hitherto an electric motor or hoist has been mounted on a rail and moved from end to end to maintain a fixed height while moving along the rail.

The invention allows for the first carriage to be moved manually along the guide rail and the vertical movement of the carriage by means of ropes, cables or wires carried by the moving carriages. The invention also allow for electric or hydraulic or various powered lifts or winches to be attached to the moving carriages to travel along the guide rail.

The invention is particularly beneficial in applications where it is desirable to move the load along the guide rail while being driven from one end in hazardous or dangerous environments that may require persons to travel horizontally at a fixed height above water or sheer drops and then vertically down a sheer face or drop or shaft. The invention allows the person to be moved with precision at a fixed height to a desired position. The apparatus of the invention may be suspended by a crane or other lifting device to be placed in position.

The supported guide rail may comprise a support bar with a rigid guide rail affixed to the bar. In some applications, the supported guide rail may comprise a tensioned wire or cable or pairs of parallel wires or cables, for example centenary wires, along which the carriages may run. Advantageously, tensioned wires or cables may allow the apparatus of the invention to be employed over much greater spans than if a support bar and rigid rail were employed. Theatrical flying outdoors maintaining a fixed or variable height while moving along a cable over water, vertical obstacles and other dangerous or hazardous environments may be achieved.

A particular benefit of the present invention is that the load carried by the lift line does not adversely impact on the lateral loads applied to the first or second carriage which remain in balance. Accordingly, lowering or raising the load does not affect the lateral stability and creep of the carriage along the guide rail is avoided. Irrespective of the load carried by the lift line, no greater force is required to effect movement of the first carriage along the guide rail. Further, this provides for a safer working procedure for an operator of a transverse line for moving the carriages as energy to overcome the frictional forces between the carriages and the guide rail is required and is independent of the load being lifted or lowered. In assembling the apparatus, suitably a load is applied to the lines of the compensator system to ensure the lines remain engaged with the guide means. In moving the first carriage along the track, there is no change in the overall length of the first and second line.

The invention is described with reference to the accompanying drawings in which.

Figure 1:
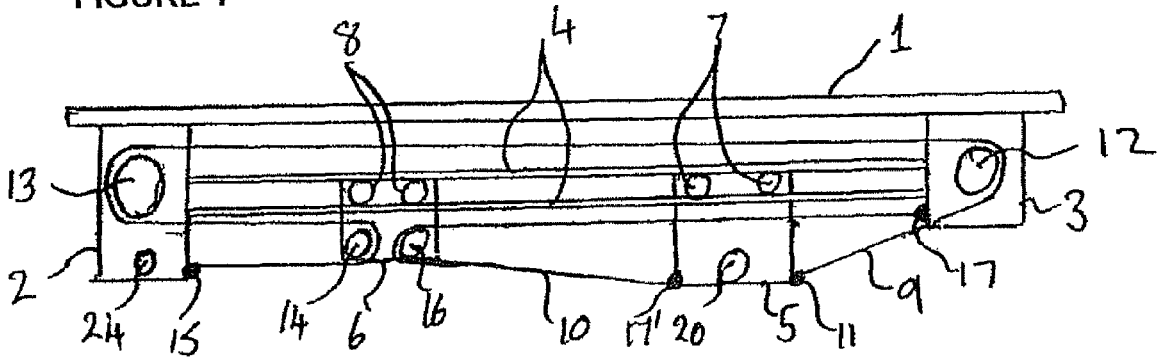
FIG. 1 shows a schematic diagram of a first embodiment of an apparatus according to the invention which shows the locus of the first and second line of the compensator system.

In FIG. 1 the apparatus comprises a support bar (1), a head block (2), a tail block (3) and a pair of guide rails (4) supported between the head block (2) and tail block (3). A first carriage (5) and a second carriage (6) are both rollably mounted on the guide rails (4) by means of pairs of rollers (7) and (8) respectively. The compensator system in FIG. 1 comprises first line (9) and second line (10) and pulleys (12), (13), (14) and (16) which act as guide means for the first and second lines (9) and (10). The first line (9) is anchored to the first carriage (5) at point (11), extends in a single pass to tail block (3) and passes around pulley (12), along the length of the guide rails (4) to pulley (13) and, in a first pass, to pulley (14) on the second carriage (6) and in a second pass from pulley (14) to anchor point (15).

On moving the first carriage (5) towards tail block (3) by a distance of "x", the first line (9) is shortened by a length "x" between anchor point (11) and pulley (12). This length "x" is taken up by the line (9) between pulleys (13) and (14) and also between pulley (14) and anchor point (15) both stretches of line being lengthened by a distance "x/2". In other words second carriage (6) moves in the same direction as first carriage (5) but by a length "x/2". The second line (10) attached to the first carriage at anchor (17') and the tail block (3) at anchor (17) acts on pulley (16) to pull the second carriage (6) in the same direction as the first carriage (5), extending the line (10) by length "x/2".

The first carriage (5) and/or second carriage (6) may be moved along the track by conventional means for example a traverse line (not shown).

Figure 2:
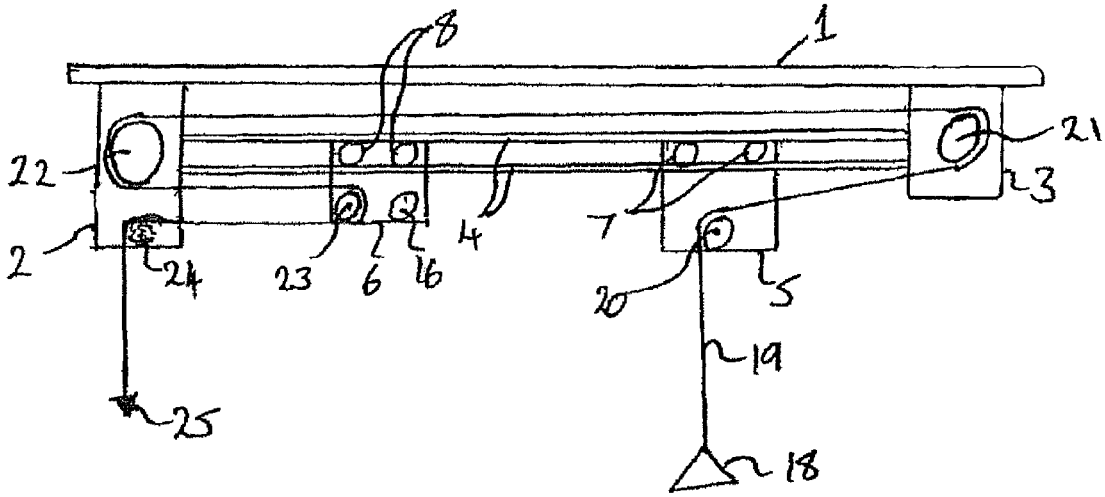
FIG. 2 shows a schematic diagram of part of an apparatus according to the invention which shows the locus of the lift line.

Pulleys (20) and (24) are shown in FIG. 1 and act as guide means for the lifting line as shown in FIG. 2.

The assembly shown in FIG. 2 may be employed with the apparatus of the invention shown in FIG. 1 to provide a further embodiment of the invention. In FIG. 2, load (18) is attached to lift line (19). Lift line (19) passes over a pulley (20) on the first carriage (5) and around a pulley (21) which is preferably co-axial with the pulley (12) of the compensation system shown in FIG. 1. The lift line (19) passes over pulley (22) which is suitably coaxial with pulley (13) of the compensator system shown in FIG. 1, and around pulley (23) which is suitably coaxial with pulley (14) of the compensator system. Lift line (19) then passes around pulley (24) and to a manual or powered lifting/lowering facility (25), for example a winch. Although some pulleys of the lift line (19) are suitably coaxial with some pulleys of the compensator system shown in FIG. 1, the lift line (19) is operated independently of the first line (9) and second line (10) of the compensator system.

A second pair of parallel guide rails, parallel to the guide rails (4) shown may also be employed for engaging the second pairs of rollers (7) and (8) not shown on the opposite side of carriages (5) and (6) respectively.

Figure 3:
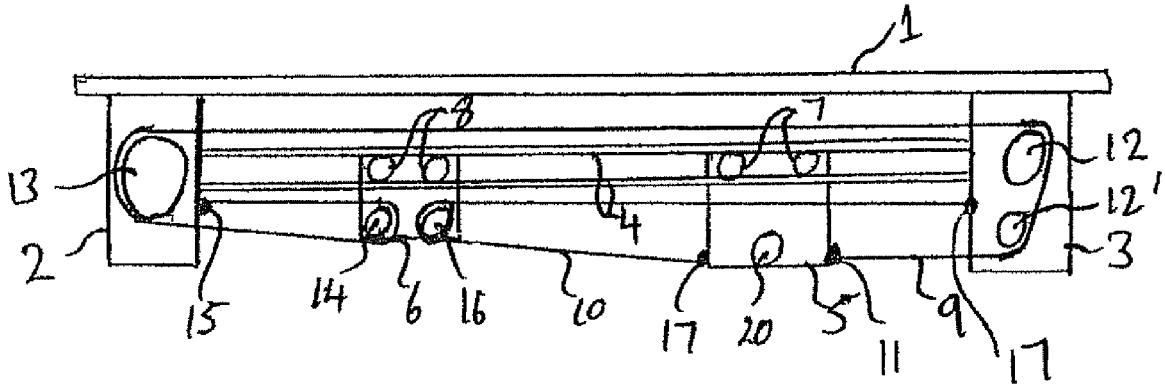
FIG. 3 shows a schematic diagram of a second embodiment of an apparatus according to the invention which shows the locus of the first and second line of the compensator system.
Figure 4:
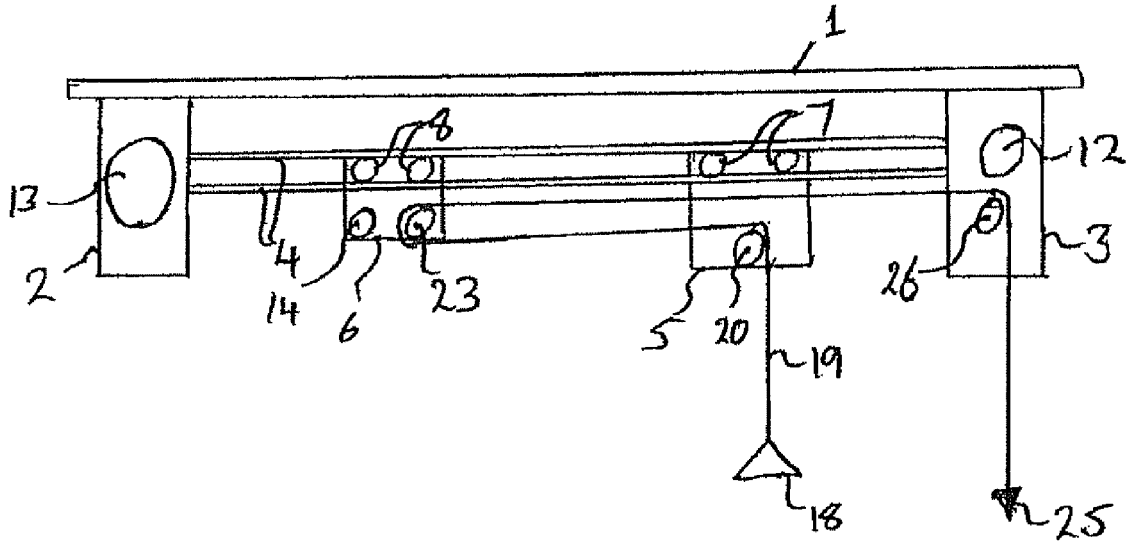
FIG. 4 shows a schematic diagram of part of an apparatus according to the invention which shows the locus of the lift line.

In FIGS. 3 and 4 show an alternative arrangement for the compensator system and the lifting line. In FIG. 3, the apparatus comprises a support bar (1), a head block (2), a tail block (3) and a pair of guide rails (4) supported between the head block (2) and tail block (3). A first carriage (5) and a second carriage (6) are both rollably mounted on the guide rails (4) by means of pairs of rollers (7) and (8) respectively. The compensator system in FIG. 3 comprises first line (9) and second line (10) and pulleys (12), (12'), (13), (14) and (16) which act as guide means for the first and second lines (9) and (10). The first line (9) is anchored to the first carriage (5) at point (11), extends in a single pass to tail block (3) and passes around pulleys (12) and (12'), along the length of the guide rails (4) to pulley (13) and, in a first pass, to pulley (14) on the second carriage (6) and in a second pass from pulley (14) to anchor point (15).

On moving the first carriage (5) tail block (3) by a distance of "x", the first line (9) is shortened by a length "x" between anchor point (11) and pulley (12'). This length "x" is taken up by the line (9) between pulleys (13) and (14) and also between pulley (14) and anchor point (15) both stretches of line being lengthened by a distance "x/2". In other words second carriage (6) moves in the same direction as first carriage (5) but by a length "x/2". The second line (10) acts on pulley (16) to pull the second carriage (6) in the same direction as the first carriage (5). Where carriage (5) moves in the direction towards carriage (6), the line (9) is lengthened by distance "x" between pulley (12') and anchor point (11) and correspondingly, the line (9) between pulleys (13) and (14) is shortened by length "x/2" as is the line (9) between pulley (14) and anchor point (15).

The first carriage (5) and/or second carriage (6) may be moved along the track by conventional means for example a traverse line (not shown).

The assembly shown in FIG. 4 may be employed with the apparatus of the invention shown in FIG. 3 to provide a further embodiment of the invention. In FIG. 4, load (18) is attached to lift line (19). Lift line (19) passes over a pulley (20) on the first carriage (5) and around a pulley (23) on the second carriage (6) which is preferably co-axial with the pulley (16) of the compensation system shown in FIG. 3. The lift line (19) passes back to pulley (26) which is suitably coaxial with pulley (12') of the compensator system shown in FIG. 3. Lift line (19) then passes to a manual or powered lifting/lowering facility (25), for example a winch. Although some pulleys of the lift line (19) are suitably coaxial with some pulleys of the compensator system shown in FIG. 3, the lift line (19) is operated independently of the first line (9) and second line (10) of the compensator system.

The invention claimed is:

1. A theatrical transportation apparatus for use in carrying a theatrical load comprising a supported guide rail, a head block located at or towards one end of the guide rail and a tail block located at or towards the other end of the rail, a first carriage movably mounted on the guide rail and a second carriage movably mounted on the guide rail, the first carriage being adapted to carry a movable lift line for carrying the load, and a compensator system linking the first and second carriage via a first compensator line which makes a greater number of passes from the second carriage to the head block than it makes from the tail block to the first carriage and being arranged such that on movement of the first carriage or the second carriage, the other carriage moves in the same direction and the second carriage moves a shorter distance than the first carriage.

2. A theatrical transportation apparatus for use in carrying a theatrical load comprising a supported guide rail, a head block located at or towards one end of the guide rail and a tail block located at or towards the other end of the rail, a first carriage movably mounted on the guide rail and carrying a movable lift line for carrying the load and a second carriage movably mounted on the guide rail, guide means for guiding the lift line on at least the first carriage, the second carriage and at least one of the head block and the tail block and a compensator system comprising a first line guided in a pathway around the head block and the tail block to link the first and second carriage and being anchored at both ends and making a greater number of passes from the second carriage to the head block than it makes from the tail block to the first carriage and a second line guided in a pathway to link the first and second carriage, the arrangement being such that the first and second carriage are simultaneously movable in the same direction and the second carriage travels a fraction of the distance of the first carriage upon effecting movement of the carriages.

3. A theatrical transportation apparatus for use in carrying a theatrical load comprising a supported guide rail, a head block comprising a pulley located at or towards one end of the guide rail and a tail block comprising a pulley located at or towards the other end of the rail, a first carriage movably mounted on the guide rail adapted to carry a suspension line for carrying a theatrical load, and a second carriage movably mounted on the guide rail located between the head block and the first carriage and being movable in the same direction as the first carriage, the second carriage comprising a pulley wherein the first carriage and second carriage are linked by first and second lines, wherein the first line has at least a single pass from the first carriage to the tail block, a single pass from the tail block to the head block and a pass from the head block to the second carriage and returning to the head block whereby the number of passes between the head block and the second carriage is greater than the number of passes between the first carriage and the tail block, and wherein the second line directly links the first and second carriages and is secured to the tail block, the arrangement being such that when the first carriage moves a distance "x", the second carriage moves a distance "x/n" in the same direction wherein n is the ratio of the number of passes between the head block and the second carriage to the number of passes from the tail block to the second carriage.

4. A theatrical transportation method for transporting a theatrical load from a first position to a second position in the air, the theatrical load being attached to a lift line, comprising mounting a first carriage and a second carriage on a guide rail, connecting the first and second carriage together by a line passing between the first carriage and the second carriage via guide means located at or near both ends of the guide rail and making a second pass of line from the second carriage and in a direction away from the first carriage whereby there are a greater number of passes from the second carriage to guide means located at or near one end than from the guide means located at or near the other end to the first carriage, connecting the first and second carriage by a second line linking the carriages directly, securing both ends of the first and second line to the arrangement being such that movement of the first carriage causes the second carriage to move in the same direction as the first carriage and to move a fraction of the distance moved by the first carriage, mounting a lift line in guide means on the first carriage and the second carriage whereby a first end is adapted to receive a load to be carried below the first carriage and the other end is linked to drive means whereby the load is liftable independently of movement of the first carriage along the guide rail and effecting movement of the load horizontally by moving the first carriage and/or vertically by moving the lift line.

* * * * *